US008007290B1

(12) United States Patent
Wolff et al.

(10) Patent No.: US 8,007,290 B1
(45) Date of Patent: Aug. 30, 2011

(54) MOUNTING DEVICE FOR A CONNECTOR

(75) Inventors: Martin Wolff, Lund (SE); Omid Kazemifar, Staffanstorp (SE); Ninus Brodin, Blentarp (SE); Daniel Skagmo, Lund (SE); Peter Sendelius, Lund (SE); Bengt Mattsson, Helsingborg (SE); Maria Romedahl, Dalby (SE); Jonas Bergkvist, Bjarred (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/791,479

(22) Filed: Jun. 1, 2010

(51) Int. Cl.
*H01R 12/00* (2006.01)

(52) U.S. Cl. ..... 439/79; 439/78

(58) Field of Classification Search ..... 439/574, 439/78, 79, 83, 668, 669, 607.4, 607.35
See application file for complete search history.

(56) References Cited

U.S. PATENT DOCUMENTS

| | | | | |
|---|---|---|---|---|
| 6,109,966 | A * | 8/2000 | Chiou | 439/607.03 |
| 6,364,708 | B1 * | 4/2002 | Chen et al. | 439/607.37 |
| 6,666,694 | B1 * | 12/2003 | Daly et al. | 439/79 |
| 6,902,432 | B2 * | 6/2005 | Morikawa et al. | 439/607.41 |
| 7,182,610 | B2 * | 2/2007 | Lin | 439/79 |
| 7,252,549 | B2 * | 8/2007 | Nishio et al. | 439/607.55 |
| 7,285,731 | B2 * | 10/2007 | Kohonen et al. | 174/355 |

* cited by examiner

*Primary Examiner* — T C Patel
*Assistant Examiner* — Phuong Nguyen
(74) *Attorney, Agent, or Firm* — Edwards Angell Palmer & Dodge LLP; Peter F. Corless; James M. Behmke

(57) ABSTRACT

A mounting device for mounting a connector to an opening of an electronic device, an electronic device comprising the mounting device, and a method for mounting a connector to an opening of an electronic device are described.

10 Claims, 2 Drawing Sheets

MOUNTING DEVICE FOR A CONNECTOR

BACKGROUND OF THE INVENTION

The present invention relates to a mounting device for mounting a connector to an opening of an electronic device, especially for mounting a connector to an opening of a printed circuit board. Furthermore, the present invention relates to an electronic device comprising the mounting device and to a method for mounting a connector to an opening of an electronic device with the mounting device.

BRIEF SUMMARY OF THE INVENTION

According to an embodiment, a mounting device for mounting a connector to an opening of an electronic device is provided. The mounting device comprises a lower sheet and an upper sheet. The lower sheet is formed to enclose a lower part of the connector and comprises a first locking mechanism at a first edge of the lower sheet and a second locking mechanism at a second edge of the lower sheet opposite to the first edge. The upper sheet is formed to enclose an upper part of the connector and comprises a third locking mechanism at a first edge of the upper sheet and a fourth locking mechanism at a second edge of the upper sheet opposite to the first edge. The lower sheet and the upper sheet are formed to enclose the connector at least partially when the first locking mechanism engages the third locking mechanism and the second locking mechanism engages the fourth locking mechanism. The first locking mechanism and the third locking mechanism are furthermore adapted to engage a first edge of the opening of the electronic device when the first locking mechanism engages the third locking mechanism. Furthermore, the second locking mechanism and the fourth locking mechanism are adapted to engage a second edge of the opening opposite to the first edge of the opening when the second locking mechanism engages the fourth locking mechanism.

The connector may comprise for example an USB connector having an opening for releasably receiving a matching USB connector in an axial direction. The upper sheet and the lower sheet may then enclose the USB connector circumferentially around the axial direction.

The mounting device may further be adapted for mounting the connector to the opening of a printed circuit board of the electronic device.

Connectors, for example USB connectors, may commonly be connected or mounted to an electronic device, for example to a printed circuit board, in a so-called mid-mounted arrangement. In this mid-mounted arrangement a cutout or opening is provided in the printed circuit board in an edging area or border area of the printed circuit board. Typically, this cutout is of a rectancular shape with three side of the cutout being formed by the printed circuit board. The connector is arranged within the cutout and solder connections of the connector are soldered to corresponding pads of the printed circuit board. However, when a matching connector is inserted or removed from the soldered connector mechanical forces are exerted on the connector and thus on the soldering joints. By mounting the connector to the opening by using the above-defined mounting device, the mounting of the connector is reinforced as the lower and upper sheets enclose the connector and engage with opposite edges of the opening. As the mounting device comprises two sheets, the upper sheet and the lower sheet, having locking mechanisms at their edges, the mounting device can easily be mounted at the connector and at the opening. As the upper and the lower sheets are separate components, they are not depending on any positioning tolerances.

According to an embodiment, the upper and lower sheets enclose the connector in a tight-fit manner when the first locking mechanism engages the third locking mechanism and the second locking mechanism engages the fourth locking mechanism. By enclosing the connector in a tight-fit manner, thus squeezing the connector between the sheets, the connector can be reliably held in the desired position and forces exerted on the connector are received by the upper and lower sheets thus avoiding forces being exerted on the soldering joints.

According to another embodiment, the first locking mechanism and the third locking mechanism compose a cooperating snap-in locking mechanism. Furthermore, the second locking mechanism and the fourth locking mechanism may compose a cooperating snap-in locking mechanism. By using snap-in locking mechanisms for locking the upper and lower sheets the mounting device can be assembled without the use of special tools.

According to another embodiment the upper sheet and the lower sheet are made of metal. By forming the upper and lower sheets of metal a high stability of the mounting device can be achieved and additionally a shielding against electrical fields may be achieved.

According to an embodiment one of the first locking mechanism and the third locking mechanism comprises a resilient tongue, and the other of the first locking mechanism and the third locking mechanism comprises a cutout. The resilient tongue and the cutout are configured such that the resilient tongue snaps into the cutout when the first locking mechanism engages the third locking mechanism. The resilient tongue may be integrally formed with one of the lower and upper sheets. In the same way, one of the second and fourth locking mechanisms may comprise a resilient tongue, and the other of the second and fourth locking mechanisms may comprise a cutout, and the resilient tongue and the cutout may be configured such that the resilient tongue snaps into the cutout when the second locking mechanism engages the fourth locking mechanism. The resilient tongue may be integrally formed with one of the lower and upper sheets. The resilient tongue and the cutout can be formed at the sheets at low cost and provide an easy to use locking mechanism which can be locked without specific tools.

According to another embodiment the first locking mechanism comprises at least one cutout and a first protruding edge, and the third locking mechanism comprises at least one resilient tongue. Similarly, the second locking mechanism comprises at least one cutout and a second protruding edge, and the fourth locking mechanism comprises at least one resilient tongue. The at least one cutout of the first locking mechanism and the at least one resilient tongue of the third locking mechanism are configured such that the at least one resilient tongue snaps into the at least one cutout when the first locking mechanism engages the third locking mechanism. Furthermore, the at least one cutout of the second locking mechanism and the at least one resilient tongue of the fourth locking mechanism are configured such that the at least one resilient tongue snaps into the at least one cutout when the second locking mechanism engages the fourth locking mechanism. When the first locking mechanism engages the third locking mechanism, the first protruding edge and the at least one resilient tongue of the third locking mechanism engage the first edge of the opening of the electronic device. Likewise, when the second locking mechanism engages the fourth locking mechanism, the second protruding edge and the at least one resilient tongue of the fourth locking mechanism engage the second edge of the opening of the electronic device. Thus, the resilient tongues may be used for snapping into the corresponding cutouts thus forming a locking mechanism for enclosing the connector, and additionally, the resilient tongues compose in combination with the protruding edges an engagement for coupling the mounting device to the edges of the opening of the electronic device.

According to an embodiment, the first locking mechanism comprises two cutouts and a first protruding edge, and the third locking mechanism comprises two corresponding resilient tongues. The two cutouts of the first locking mechanism and the two resilient tongues of the third locking mechanism are configured such that the resilient tongues snap into the cutouts when the first locking mechanism engages the third locking mechanism. Likewise, the second locking mechanism comprises two cutouts and a second protruding edge, and the fourth locking mechanism comprises two corresponding resilient tongues. The two cutouts of the second locking mechanism and the two resilient tongues of the fourth locking mechanism are configured such that the resilient tongues snap into the cutouts when the second locking mechanism engages the fourth locking mechanism. Furthermore, when the first locking mechanism engages the third locking mechanism, the first protruding edge and the two resilient tongues of the third locking mechanism engage the first edge of the opening of the electronic device, and when the second locking mechanism engages the fourth locking mechanism, the second protruding edge and the two resilient tongues of the fourth locking mechanism engage the second edge of the opening of the electronic device.

According to yet another embodiment, an electronic device is provided which comprises the above-described mounting device.

The electronic device may be for example a mobile phone, a personal digital assistant, a mobile navigation system, a mobile media player or a mobile computer.

According to an embodiment, a method for mounting a connector to an opening of an electronic device is provided. According to the method, the connector is mounted to the electronic device by using a mounting device comprising a lower sheet and an upper sheet. The lower sheet is formed to enclose a lower part of the connector and comprises a first locking mechanism at a first edge of the lower sheet and a second locking mechanism at a second edge of the lower sheet opposite to the first edge. The upper sheet is formed to enclose an upper part of the connector and comprises a third locking mechanism at a first edge of the upper sheet and fourth locking mechanism at a second edge of the upper sheet opposite to the first edge. The lower sheet and the upper sheet are formed to enclose the connector at least partially when the first locking mechanism engages a third locking mechanism and the second locking mechanism engages the fourth locking mechanism. The first locking mechanism and the third locking mechanism are adapted to engage a first edge of the opening when the first locking mechanism engages the third locking mechanism, and the second locking mechanism and the fourth locking mechanism are adapted to engage a second edge of the opening opposite to the first edge of the opening when the second locking mechanism engages the fourth locking mechanism.

According to an embodiment, the method comprises furthermore the following steps. The connector is enclosed with the lower sheet and the upper sheet of the mounting device and the first locking mechanism is locked with the third locking mechanism and the second locking mechanism is locked with the fourth locking mechanism. The enclosed connector is engaged with the electronic device by engaging the first locking mechanism and the third locking mechanism with the first edge of the opening of the electronic device and by engaging the second locking mechanism and the fourth locking mechanism with the second edge of the opening of the electronic device.

Although specific features described in the above summary and in the following detailed description are described in connection with specific embodiments, it is to be understood that the features of the embodiments described can be combined with each other unless it is noticed otherwise.

BRIEF DESCRIPTION OF THE DRAWINGS

Hereinafter, exemplary embodiments of the invention will be described with reference to the drawings.

DETAILED DESCRIPTION OF THE INVENTION

In the following, exemplary embodiments of the present invention will be described in detail. It is to be understood that the following description is given only for the purpose of illustrating the principles of the invention and not to be taken in a limiting sense. Rather, the scope of the invention is defined only by the appended claims and not intended to be limited by the exemplary embodiments hereinafter.

It is to be understood that the features of the various exemplary embodiments described herein may be combined with each other unless specifically noted otherwise. Same reference signs in the various instances of the drawings refer to similar or identical components.

Figure 1:
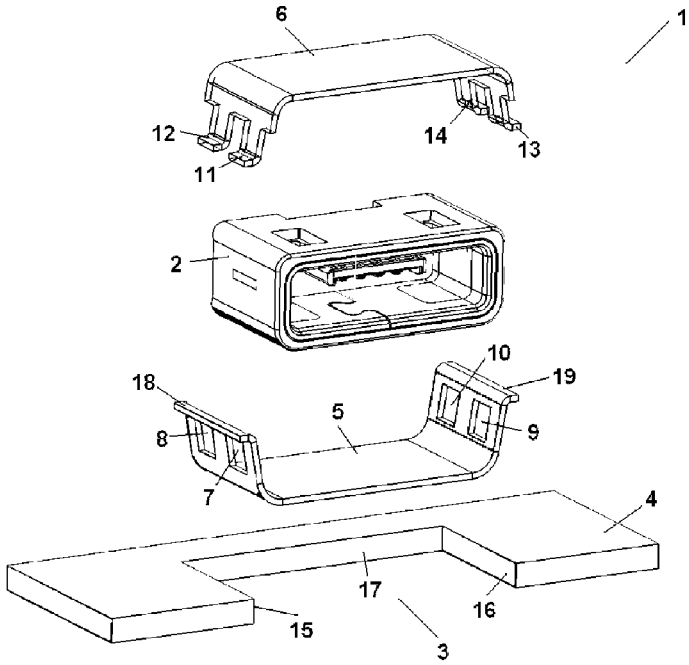
FIG. 1 shows an exploded view of a connector, a printed circuit board and a mounting device according to an embodiment of the present invention.

FIG. 1 shows an exploded view of a mounting device 1 for mounting a connector 2 to an opening 3 of a printed circuit board 4. The circuit board 4 may be a circuit board of any mobile or stationary device, for example a mobile computer, a stationary computer, a mobile phone or a mobile navigation system. The connector 2 may be any kind of connector, for example a USB connector, a FireWire connector or a charging connector for a battery powered device. Although in the following description the mounting device 1 will be described in connection with the printed circuit board 4, the mounting device 1 may be used to mount the connector 2 to an opening of any other kind of electronic device.

The opening 3 of the printed circuit board 4 is a cutout in the printed circuit board 4 at an edge or border of the printed circuit board 4. The opening 3 is dimensioned such that the connector 2 can be mounted within the opening 3. The opening 3 comprises three cutout edges, a first edge 15, a second edge 16 opposite to the first edge 15, and a third edge 17 connecting the first edge 15 and the second edge 16. When the connector 2 is arranged within the opening 3, the connector 2 may be electrically coupled to the printed circuit board 4 via solder connections (not shown) extending from the back side of the connector 2 to solder pads arranged on the printed circuit board 4 along the third edge 17. Thus, the connector 2 is arranged in a so-called mid-mounted position with respect to the printed circuit board 4. For reinforcing the arrangement of the connector 2 in the opening 3, the mounting device 1 may be used.

The mounting device 1 comprises a lower sheet 5 and an upper sheet 6. The lower sheet 5 and the upper sheet 6 may be formed of metal, plastics or any other suitable material. The lower sheet 5 is formed such that it encloses a lower part of the connector 2. Furthermore, the lower sheet 5 comprises a first locking mechanism at a first edge (the left edge in FIG. 1) of the lower sheet 5 and a second locking mechanism at a second edge (the right edge in FIG. 1) of the lower sheet 5. The first locking mechanism comprises two cutouts 7 and 8 and the second locking mechanism comprises two cutouts 9 and 10. Furthermore, the first locking mechanism comprises a protruding edge 18 extending away from the lower sheet 5 in the left direction and the second locking mechanism comprises additionally a second protruding edge 19 extending away from the lower sheet 5 in the right direction.

The upper sheet 6 is formed such that it is adapted to enclose an upper part of the connector 2. The upper sheet 6 comprises a third locking mechanism at a first edge (the left edge in FIG. 1) of the upper sheet 6 and a fourth locking mechanism at a second edge (the right edge in FIG. 1) of the upper sheet 6. The third locking mechanism comprises two tongues 11 and 12 having protrusions extending away from the upper sheet 6 in the left direction. The fourth locking mechanism comprises two tongues 13 and 14 having protrusions extending away from the upper sheet 6 in the right direction. The tongues 11 and 12 are arranged such that they can be engaged with the cutouts 7 and 8 of the lower sheet 5. Likewise, the tongues 13 and 14 are configured such that they can be engaged with the cutouts 9 and 10 of the lower sheet 5.

Figure 2:
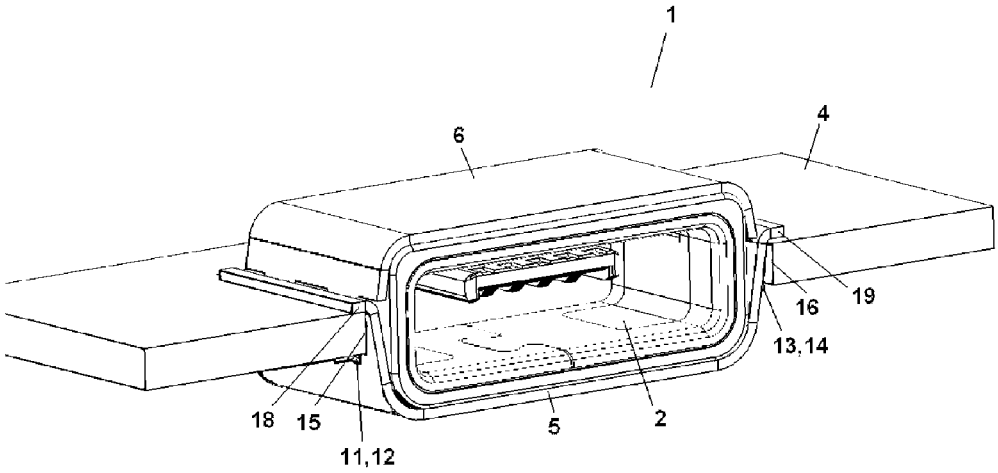
FIG. 2 shows a perspective view of the component of FIG. 1 in an assembled state.

FIG. 2 shows the mounting device 1, the connector 2 and the printed circuit board 4 of FIG. 1 in an assembled state. The upper part 6 of the mounting device 1 encloses an upper part of the connector 2 and the lower sheet 5 of the mounting device 1 encloses the lower part of the connector 2. The tongues 11 to 14 of the upper sheet 6 are engaged with the cutouts 7 to 10 of the lower sheet 5. Engagement of the tongues 11 to 14 with respective cutouts 7 to 10 is achieved by the tongues 11 to 14 resiliently snapping into the cutout 7 to 10 when the lower sheet 5 and the upper sheet 6 are pressed against each other enclosing the connector 2. Thus, the connector 2 is tight-fit enclosed by the lower sheet 5 and the upper sheet 6. Furthermore, the first protruding edge 18 and the protrusions of the tongues 11, 12 engage the first edge 15 of the opening 3. Likewise, the second protruding edge 19 and the protrusions of the tongues 13, 14 engage the second edge 16 of the opening 3. Thus, the mounting device 1 is reliably mounted to the printed circuit board 4.

Figure 3:
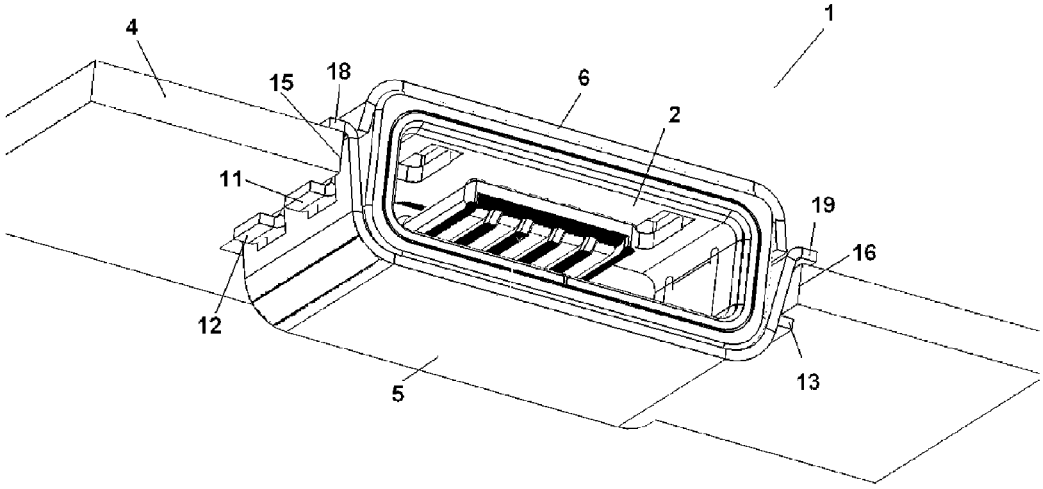
FIG. 3 shows another perspective view of the components of FIG. 1 in an assembled state.

FIG. 3 shows the arrangement of the mounting device 1, the connector 2, and the printed circuit board 4 in another perspective view, wherein the protrusions of the tongues 11 and 12 and the mounting of the first protrusion 18 and the tongues 11 and 12 to the first edge 15 of the printed circuit board 4 can be seen in more detail.

Figure 4:
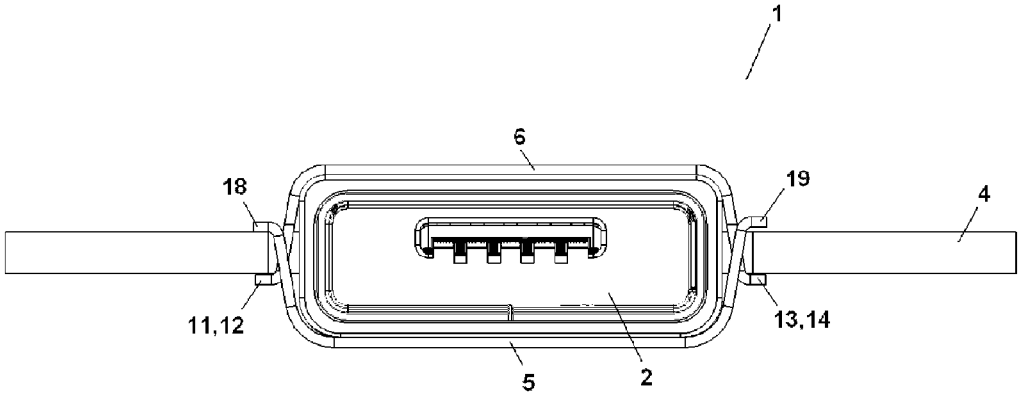
FIG. 4 shows a plan view of the components of FIG. 1 in an assembled state.

FIG. 4 shows a plan view of the arrangement of the mounting device 1, the connector 2, and the printed circuit board 4. As can be seen, the lower sheet 5 and the upper sheet 6 enclose the connector 2 in a tight-fit manner and additionally the combination of the tongues 11, 12 and the first protrusion 18 engages the first edge 15 of the printed circuit board 4, and in the same way the combination of the tongues 13, 14 and the second protrusion 19 engages the second edge 16 of the printed circuit board 4.

As can be seen from the figures and the description above, a mounting of a mid-mounted connector, for example an USB connector, can be reinforced by using the mounting device 1 comprising two metal frames of sheets 5, 6 to support the connector 2. The connector 2 is squeezed in between the sheets. The sheets 5, 6 are stand alone components allowing that they are not depending on any positioning tolerances. Furthermore, the sheets 5, 6 are designed to be snapped and locked to each other and squeeze both the connector 2 and the printed circuit board 4 at the same time. Finally, due to the snap-in mechanism for coupling the sheets 5, 6, the sheets 5, 6 can easily be mounted and dismounted and may therefore be reused again.

While exemplary embodiments have been described above, various modifications may be implemented in other embodiments. For example, the number of tongues 11-14 and cutouts 7-10 may be varied as required by the size of the connector 2. Furthermore, any other kind of connector, for example a FireWire connector or a charging connector, may be used instead of the USB connector shown in the figures. Furthermore, the mounting device 1 may be used to mount the connector 2 to an opening of any other structure of an electronic device, for example to a housing part of the electronic device.

Finally, it is to be understood that all the embodiments described above are considered to be comprised by the present invention as it is defined by the appended claims.

What is claimed is:

1. A mounting device for mounting a connector to an opening of an electronic device, the mounting device comprising:

a lower sheet formed to enclose a lower part of the connector, the lower sheet comprising a first locking mechanism at a first edge of the lower sheet and a second locking mechanism at a second edge of the lower sheet opposite to the first edge, and an upper sheet formed to enclose an upper part of the connector, the upper sheet comprising a third locking mechanism at a first edge of the upper sheet and a fourth locking mechanism at a second edge of the upper sheet opposite to the first edge, wherein the lower sheet and the upper sheet are formed to enclose the connector at least partly when the first locking mechanism engages the third locking mechanism and the second locking mechanism engages the fourth locking mechanism, wherein the first locking mechanism and the third locking mechanism are adapted to engage a first edge of the opening when the first locking mechanism engages the third locking mechanism, wherein the second locking mechanism and the fourth locking mechanism are adapted to engage a second edge of the opening opposite to the first edge of the opening when the second locking mechanism engages the fourth locking mechanism, and wherein at least one of either i) the first locking mechanism and the third locking mechanism compose a cooperating snap-in locking mechanism or ii) the second locking mechanism and the fourth locking mechanism compose a cooperating snap-in locking mechanism.

2. The mounting device according to claim 1, wherein the upper and lower sheets enclose the connector in a tight fit manner when the first locking mechanism engages the third locking mechanism and the second locking mechanism engages the fourth locking mechanism.

3. The mounting device according to claim 1, wherein the upper sheet and the lower sheet are made of metal.

4. A mounting device for mounting a connector to an opening of an electronic device, the mounting device comprising:

a lower sheet formed to enclose a lower part of the connector, the lower sheet comprising a first locking mechanism at a first edge of the lower sheet and a second locking mechanism at a second edge of the lower sheet opposite to the first edge, and an upper sheet formed to enclose an upper part of the connector, the upper sheet comprising a third locking mechanism at a first edge of the upper sheet and a fourth locking mechanism at a second edge of the upper sheet opposite to the first edge, wherein the lower sheet and the upper sheet are formed to enclose the connector at least partly when the first locking mechanism engages the third locking mechanism and the second locking mechanism engages the fourth locking mechanism, wherein the first locking mechanism and the third locking mechanism are adapted to engage a first edge of the opening when the first locking mechanism engages the third locking mechanism, wherein the second locking mechanism and the fourth locking mechanism are adapted to engage a second edge of the opening opposite to the first edge of the opening when the second locking mechanism engages the fourth locking mechanism, and wherein at least one of either i) one of the first locking mechanism and the third locking mechanism comprises a resilient tongue, and the other of the first locking mechanism and the third locking mechanism comprises a cutout, wherein the resilient tongue and the cutout are configured such that the resilient tongue snaps into the cutout when the first locking mechanism engages the third locking mechanism, or ii) one of the second locking mechanism and the fourth locking mechanism comprises a resilient tongue, and the other of the second locking mechanism and the fourth locking mechanism comprises a cutout, wherein the resilient tongue and the cutout are configured such that the resilient tongue snaps into the cutout when the second locking mechanism engages the fourth locking mechanism.

5. The mounting device according to claim 4, wherein the resilient tongue is integrally formed with one of the lower and upper sheets.

6. The mounting device according to claim 4, wherein the first locking mechanism comprises two cutouts and a first protruding edge, the second locking mechanism comprises two cutouts and a second protruding edge, the third locking mechanism comprises two resilient tongues, and the fourth locking mechanism comprises two resilient tongues, wherein the two cutouts of the first locking mechanism and the two resilient tongues of the third locking mechanism are configured such that the resilient tongues snap into the cutouts when the first locking mechanism engages the third locking mechanism, wherein the two cutouts of the second locking mechanism and the two resilient tongues of the fourth locking mechanism are configured such that the resilient tongues snap into the cutouts when the second locking mechanism engages the fourth locking mechanism, wherein the first protruding edge and the two resilient tongues of the third locking mechanism engage the first edge of the opening of the electronic device when the first locking mechanism engages the third locking mechanism, and wherein the second protruding edge and the two resilient tongues of the fourth locking mechanism engage the second edge of the opening of the electronic device when the second locking mechanism engages the fourth locking mechanism.

7. A mounting device for mounting a connector to an opening of an electronic device, the mounting device comprising:

a lower sheet formed to enclose a lower part of the connector, the lower sheet comprising a first locking mechanism at a first edge of the lower sheet and a second locking mechanism at a second edge of the lower sheet opposite to the first edge, and an upper sheet formed to enclose an upper part of the connector, the upper sheet comprising a third locking mechanism at a first edge of the upper sheet and a fourth locking mechanism at a second edge of the upper sheet opposite to the first edge, wherein the lower sheet and the upper sheet are formed to enclose the connector at least partly when the first locking mechanism engages the third locking mechanism and the second locking mechanism engages the fourth locking mechanism, wherein the first locking mechanism and the third locking mechanism are adapted to engage a first edge of the opening when the first locking mechanism engages the third locking mechanism, wherein the second locking mechanism and the fourth locking mechanism are adapted to engage a second edge of the opening opposite to the first edge of the opening when the second locking mechanism engages the fourth locking mechanism, and wherein the mounting device is adapted for mounting the connector to the opening of a printed circuit board of the electronic device.

8. The mounting device according to claim 7, wherein the connector comprises a USB connector having an opening for releasably receiving a matching USB connector in an axial direction, wherein the upper sheet and the lower sheet encloses the USB connector circumferentially around the axial direction.

9. A method for mounting a connector to an opening of a printed circuit board of an electronic device, comprising the step of mounting the connector to the opening of the printed circuit board of the electronic device with a mounting device, the mounting device comprising:

a lower sheet formed to enclose a lower part of the connector, the lower sheet comprising a first locking mechanism at a first edge of the lower sheet and a second locking mechanism at a second edge of the lower sheet opposite to the first edge, and an upper sheet formed to enclose an upper part of the connector, the upper sheet comprising a third locking mechanism at a first edge of the upper sheet and a fourth locking mechanism at a second edge of the upper sheet opposite to the first edge, wherein the lower sheet and the upper sheet are formed to enclose the connector at least partly when the first locking mechanism engages the third locking mechanism and the second locking mechanism engages the fourth locking mechanism, wherein the first locking mechanism and the third locking mechanism are adapted to engage a first edge of the opening when the first locking mechanism engages the third locking mechanism, and wherein the second locking mechanism and the fourth locking mechanism are adapted to engage a second edge of the opening opposite to the first edge when the second locking mechanism engages the fourth locking mechanism;

wherein the first locking mechanism and the third locking mechanism compose a cooperating snap-in locking mechanism.

10. The method according to claim 9, comprising the steps of:

enclosing the connector with the lower sheet and the upper sheet of the mounting device, locking the first locking mechanism with the third locking mechanism, locking the second locking mechanism with the fourth locking mechanism, and engaging the enclosed connector with the electronic device by engaging the first locking mechanism and the third locking mechanism with the first edge of the opening of the electronic device and by engaging the second locking mechanism and the fourth locking mechanism with the second edge of the opening of the electronic device.

* * * * *